US005505760A

United States Patent [19]

Jansson

[11] Patent Number: 5,505,760

[45] Date of Patent: Apr. 9, 1996

[54] POWDER-METALLURGICAL COMPOSITION HAVING GOOD SOFT MAGNETIC PROPERTIES

[75] Inventor: Patricia Jansson, Viken, Sweden

[73] Assignee: Höganäs AB, Höganäs, Sweden

[21] Appl. No.: 196,198

[22] PCT Filed: Aug. 26, 1992

[86] PCT No.: PCT/SE92/00587

§ 371 Date: Mar. 22, 1994

§ 102(e) Date: Mar. 22, 1994

[87] PCT Pub. No.: WO93/03874

PCT Pub. Date: Mar. 4, 1993

[30] Foreign Application Priority Data

Aug. 26, 1991 [SE] Sweden ..... 9102442

[51] Int. Cl.[6] ..... C22C 33/02; H01F 1/147

[52] U.S. Cl. ..... 75/255; 75/231; 75/252

[58] Field of Search ..... 75/252, 255, 231, 75/246; 420/87

[56] References Cited

U.S. PATENT DOCUMENTS 4,093,449 6/1978 Svensson et al. ..... 75/252
4,643,765 2/1987 Takajo ..... 75/255
5,256,185 10/1993 Semel et al. ..... 75/255
5,290,336 3/1994 Luk ..... 75/252

FOREIGN PATENT DOCUMENTS 0151185 8/1985 European Pat. Off. .
0165872 12/1985 European Pat. Off. .
63-45303 2/1988 Japan .

*Primary Examiner*—George Wyszomierski
*Attorney, Agent, or Firm*—Burns, Doane, Swecker & Mathis

[57] ABSTRACT

The invention relates to an iron-based powder composition which, in addition to a substantially non-alloyed Fe-powder, comprises Sn and P, optionally lubricant and at most 1.0% by weight of impurities. In the composition, Sn and P are present as an SnP-alloy in powder form, or else Sn is present in the form of a metallic powder and P is present in the form of a ferrophosphorous powder, the Sn-content, based on the total iron-based powder composition, being at least 4.5% by weight, and the individual particles, which contain Sn and P, being present as particles substantially separate from the particles in the non-alloyed Fe-powder. Finally, Sn and P may also be present as an SnP-alloy in powder form, and Sn may also be present as a metallic powder. This composition may optionally also contain P as a ferrophosphorous powder.

7 Claims, 5 Drawing Sheets

POWDER-METALLURGICAL COMPOSITION HAVING GOOD SOFT MAGNETIC PROPERTIES

The present invention relates to an iron-based powder composition containing Sn and P for manufacturing components with stringent demands in respect of soft magnetic properties and low eddy current losses.

One of the major advantages gained from powder-metallurgical manufacture of components as compared with conventional techniques is that it permits manufacturing components in long series with high dimensional accuracy. In such manufacture, an iron base powder is mixed e.g. with additions of pulverulent alloying substances and a lubricant. The alloying substances are added to give the finished component the desired properties, whilst the lubricant is added primarily to reduce the tool wear when compacting the powder mixture. The compacting of the powder mixture into the desired shape is followed by sintering.

Powder-metallurgical manufacture of components for soft magnetic purposes is today performed primarily by compacting and high-temperature sintering, meaning temperatures above 1150° C. High-temperature sintering is relied on above all since it is known that the soft magnetic properties are improved when the sintering temperature is raised. It is above all the particle growth, but also such factors as a more homogeneous distribution of alloying substances and higher density that entail enhanced soft magnetic properties in these materials as compared with materials sintered at lower temperatures.

The major iron-based tonnage for soft magnetic purposes is manufactured with the addition of Si, both to enhance the soft magnetic properties and to increase the resistivity so as to reduce the eddy current losses in AC applications. Powder-metallurgical manufacture of Si-alloyed materials necessitates high-temperature sintering, since otherwise Si would oxidise and not be dissolved into the iron. High-temperature sintering however results in substantial shrinkage during sintering, which gives rise to difficulties in maintaining the dimensional accuracy on the components.

Components for soft magnetic purposes can also be manufactured in powder metallurgy by adding P to iron-based materials. The addition of P enhances the soft magnetic properties as compared with pure Fe and also improves the resistivity to some extent, that is, reduces the eddy current losses in AC applications. Moreover, the process technique is simple in that the components can be sintered in a belt furnace where the temperature is maximised to about 1150° C. P-alloyed materials, on the other hand, have considerably lower resistivity than today's Si-alloyed materials, both after sintering in a belt furnace and after sintering at a high temperature (t>1150° C.).

The object of the present invention therefore is to provide an iron-based powder composition which after compacting and sintering exhibits improved soft magnetic properties as compared with currently known iron-based powder-metallurgical materials;

high resistivity resulting in low eddy current losses.

Moreover, this powder composition should after compacting and sintering exhibit properties similar to those achieved with high-temperature sintering of currently known iron-based powder-metallurgical materials when sintering is performed in a belt furnace, i.e. at a maximum temperature of about 1150° C.;

small dimensional change.

According to the invention, the desired properties can be obtained by means of an iron-based powder composition which, in addition to a substantially non-alloyed Fe-powder, comprises Sn and P, optionally lubricant and at most 1.0% by weight of impurities, wherein a) Sn and P are present as an SnP-alloy in powder form, or wherein b) Sn is present in the form of a metallic powder and P is present in the form of a ferrophosphorous powder, $Fe_3P$, the Sn-content, based on the total iron-based powder composition, being at least 4.5% by weight and the individual particles, which contain Sn and P, being present as particles substantially separate from the particles in the non-alloyed Fe-powder, or wherein c) Sn and P are present as an SnP-alloy in powder form, and Sn is additionally present as a metallic powder, and wherein, optionally, P is also present as a ferrophosphorous powder $Fe_3P$.

In powder compositions according to Alternatives a) and c) above, the Sn-content may suitably range between 1.0 and 15.0% by weight and the P-content between 0.2 and 1.5% by weight. Preferably, the Sn-content ranges between 2.0 and 12.0% by weight and the P-content between 0.3 and 1.2% by weight based on the total weight of the composition. The content of impurities preferably is at most 0.5%.

In powder compositions according to Alternative b) above, the Sn-content may suitably range between 4.5 and 15% by weight, preferably between 5 and 8% by weight, based on the total weight of the iron-based powder composition.

To obtain the required Sn- and P-contents in the powder composition, an addition is made, e.g. of Sn and P as a powder of an SnP-alloy containing Sn and P in such proportions that the desired alloying contents are obtained in the sintered component.

Preferably, the particle size distribution is such that the main portion of the particles of the SnP-alloy have a size below 150 μm. Also when Sn is added as a metal powder, the particle size distribution suitably is such that the main portion of the particles have a size below 150 μm, while P is added as ferrophosphorous powder having a P-content of 12–17% by weight and such a particle size distribution that the main portion of the particles have a size below 20 μm. Further, the required Sn- and P-contents can be adjusted in the powder composition by adding an SnP-alloying powder with the indicated particle size and also Sn and/or P. In this case too, a powder of metallic Sn, an SnP-alloy and ferrophosphorus having the indicated particle sizes are also added.

It is previously known, for instance from JP 48-102008, that Sn may be included in compacted and sintered iron-based powder materials. This known powder material may optionally also contain P which, however, then is not in the form of $Fe_3P$.

EP 151,185 A1 describes the addition of Sn as an oxide powder which, after compacting and sintering, yields a material that is stated to be an improvement over previously known materials. According to this patent specification, there is also obtained a certain further improvement of the properties of this material when phosphorus in the form of $Fe_3P$ is added. However, according to this publication an addition of $Fe_3P$, together with a pure powder of metallic Sn, does not provide an overall improvement of the soft magnetic properties and the resistivity in compacted and sintered iron-based powder materials as compared with the case where $Fe_3P$ is not added. The resistivity is certainly improved, but at the same time the permeability is reduced. These results do not agree with those obtained with the present invention when a powder of metallic Sn and ferrophosphorus are added to a substantially non-alloyed Fe-powder, the Sn-content in the present compositions being suitably above 4.5% based on the weight of the total iron-based powder composition. It has further been surprisingly found in conjunction with the present invention that when Sn and P are added as an SnP-alloy in powder form to iron-based powder compositions, there is obtained after compacting and sintering not only an essential improvement of the soft magnetic properties and the resistivity as compared with an addition of a pure Sn-powder, but it is also possible to achieve clearly improved mechanical properties, such as tensile strength. It is therefore not necessary to add Sn in the form of a chemical compound of the type disclosed in EP 151,185 A1 in order, optionally together with P, to achieve improved properties in the compacted and sintered component. Moreover, the invention according to EP 151, 185 A1 involves a complicated process technique as compared with the options according to the present invention, since the material must undergo an additional annealing process.

DETAILED DESCRIPTION OF THE INVENTION

The invention will be described in more detail hereinafter in some Examples.

EXAMPLE 1

Five iron-based powder compositions (A, B, C, D, E) were manufactured by adding five different SnP-alloying powders with varying Sn/P-ratios, to an iron powder with a low content of impurities.

The reference materials employed were two known iron-based powder-metallurgical materials commonly used in soft magnetic applications, viz. Fe-3% by weight Si and Fe-0.45% by weight P as well as an Fe-5% by weight Sn-material. The nominal chemical composition appears from Table 1 below.

TABLE 1

Nominal chemical composition of the materials tested.

| Material | Chemical composition (%) | | | |
|---|---|---|---|---|
| | Sn | P | Si | Fe |
| A | 5.0 | 0.45 | — | Balance |
| B | 5.0 | 0.60 | — | Balance |
| C | 5.0 | 0.80 | — | Balance |
| D | 5.0 | 1.20 | — | Balance |
| E | 5.0 | 1.60 | — | Balance |
| Ref. 1 | — | — | 3.0 | Balance |
| Ref. 2 | — | 0.45 | — | Balance |
| Ref. 3 | 5.0 | — | — | Balance |

These powders were admixed with 0.6% Kenolube as lubricant, and after mixing test pieces were compacted at 600 MPa. Sintering was performed at 1250° C. for 30 min in a reducing atmosphere (hydrogen gas). The reference materials were sintered for 60 min.

Figure 1A:
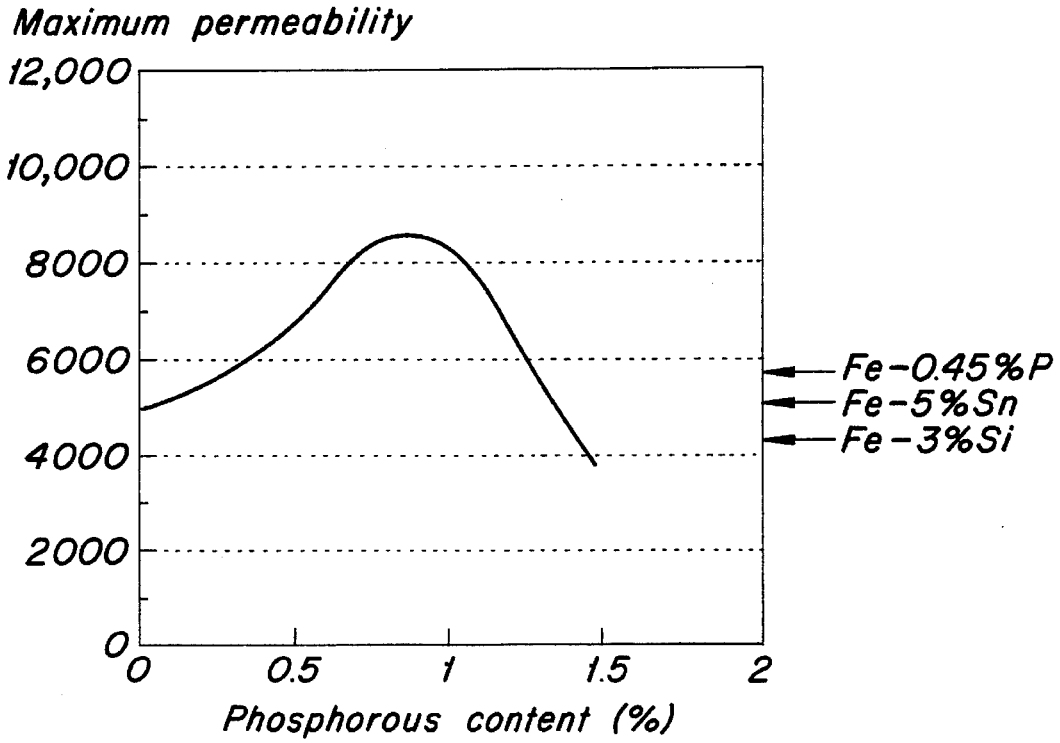
FIGS. 1*a*, 1*b*, and 1*c* show the relationship between phosphorous content and permeability, coercive force, and resistivity, respectively, in one example of the invention.
Figure 1B:
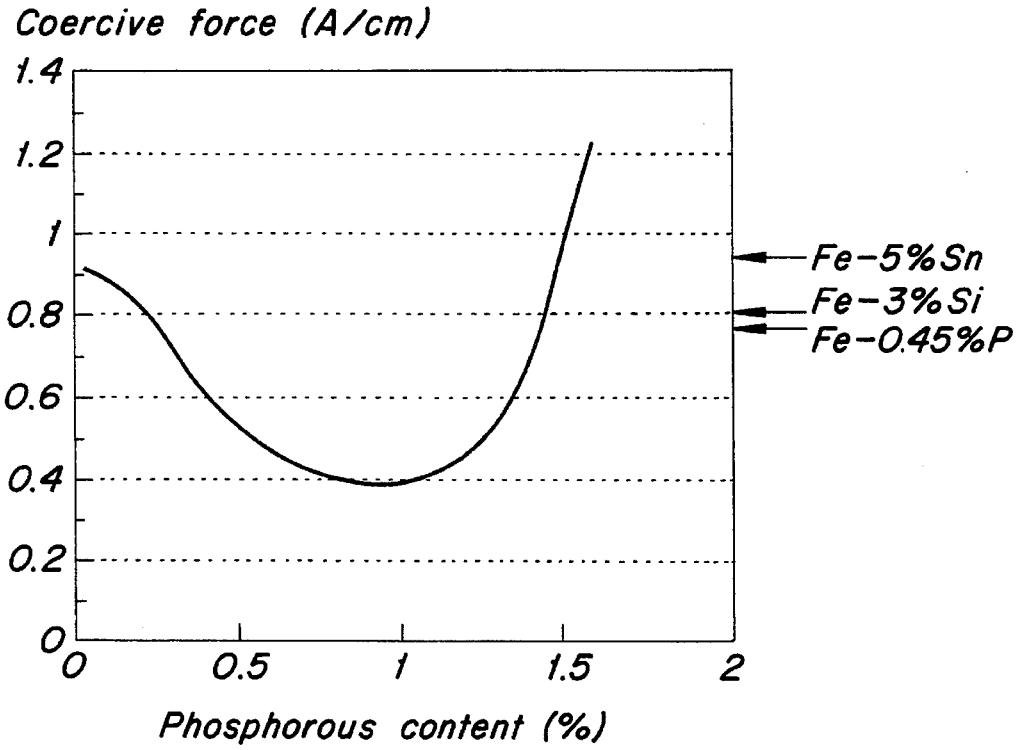
Figure 1C:
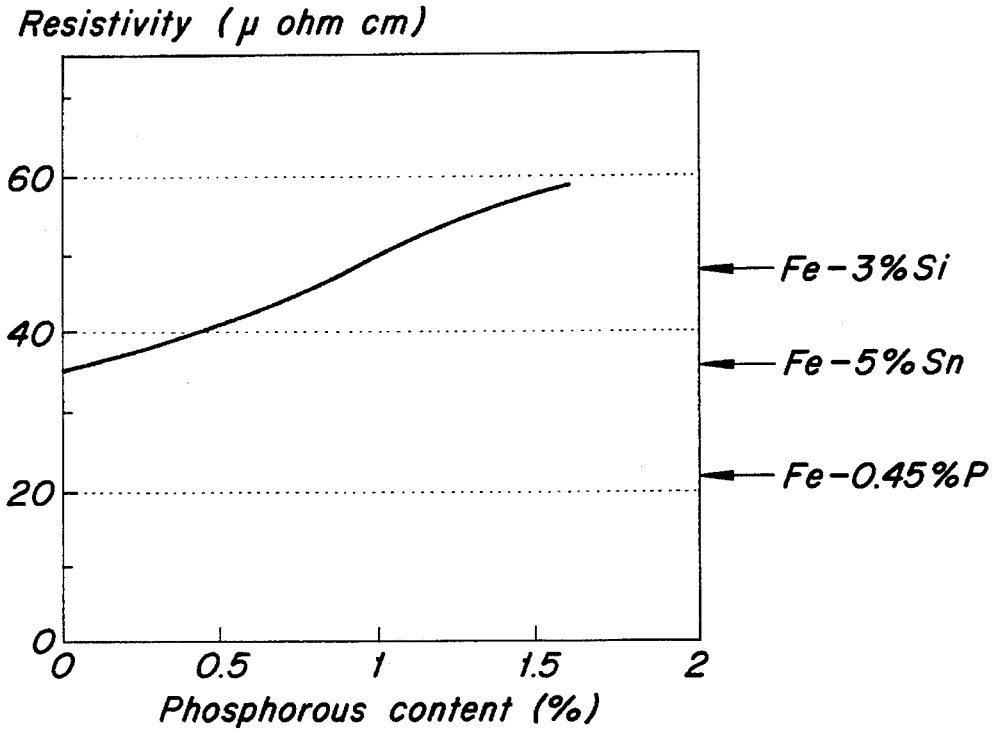

After sintering, the properties permeability, coercive force and resistivity were measured, as illustrated in FIGS. 1*a*, 1*b* and 1*c*. As appears from these Figures, there is achieved within the content range 0.2–1.5% by weight P, which is the selected content range for P in the present invention, an improved combination of the properties permeability, coercive force and resistivity than what is previously known. The upper limit for P, which is 1.5% by weight, is explained by reduced permeability and lower coercive force at higher P-contents as compared with the known reference materials. The advantage of high resistivity then does no longer make up for the poorer soft magnetic properties (lower permeability, higher coercive force). The lower limit for P, which is 0.2% by weight P, is explained by a reduction of permeability, coercive force and resistivity, such that a combination of these properties cannot be considered superior to the known technique when the P-content is below 0.2% by weight. In the preferred content range, i.e. 0.3–1.2% by weight P, the permeability is higher and the coercive force is lower in the inventive material as compared with the reference materials Fe-3% Si, Fe-0.45% P and Fe-5% Sn. The resistivity is similar for the inventive material as for Fe-3% Si, while Fe-0.45% P and Fe-5% Sn have lower resistivity. In the preferred content range for P, i.e. 0.3–1.2% by weight P, there is shown an improved combination of the properties permeability, coercive force and resistivity achievable with the inventive material as compared with the known technique.

EXAMPLE 2

Five iron-based powder compositions (F, G, H, I, J) were prepared by adding five different SnP-alloying powders with varying Sn/P-ratios, to an iron powder with a low content of impurities. The same reference materials as in Example 1 were used. The nominal chemical composition appears from Table 2 below.

TABLE 2

Nominal chemical composition of the materials tested.

| Material | Chemical composition (%) | | | |
|---|---|---|---|---|
| | Sn | P | Si | Fe |
| F | 2.0 | 0.45 | — | Balance |
| G | 5.0 | 0.45 | — | Balance |
| H | 8.0 | 0.45 | — | Balance |
| I | 10.0 | 0.45 | — | Balance |
| J | 15.0 | 0.45 | — | Balance |
| Ref. 1 | — | — | 3.0 | Balance |
| Ref. 2 | — | 0.45 | — | Balance |
| Ref. 3 | 5.0 | — | — | Balance |

These powders were admixed with 0.6% Kenolube as lubricant, and after mixing test pieces were compacted at 600 MPa. Sintering was performed at 1250° C. for 30 min in a reducing atmosphere (hydrogen gas). The reference materials were sintered for 60 min.

Figure 2A:
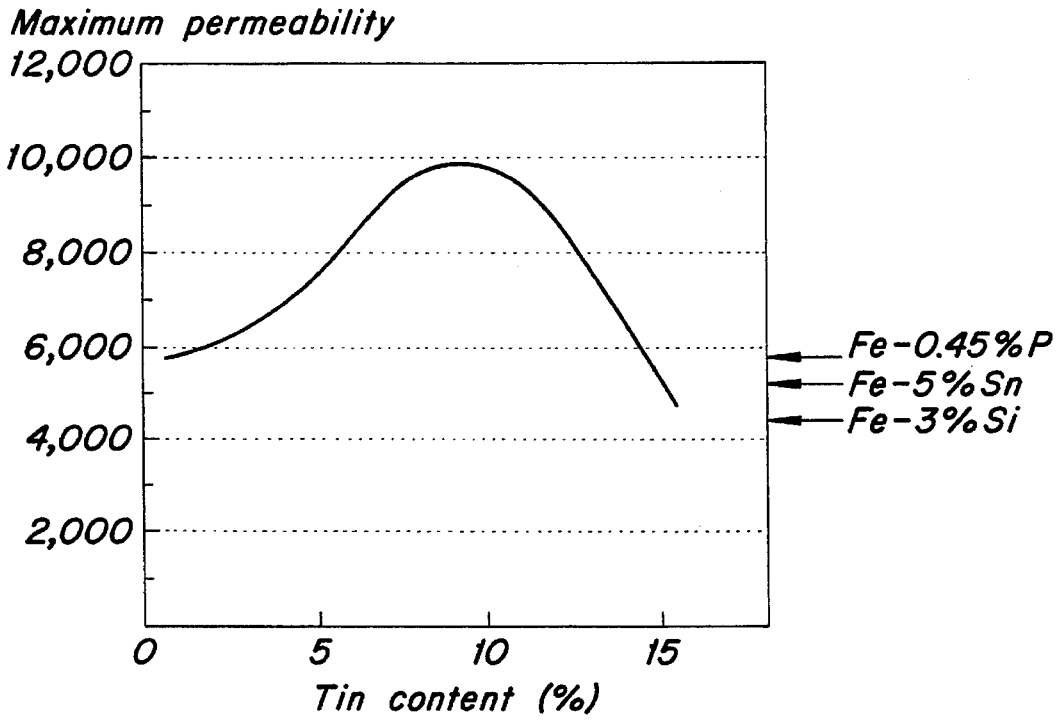
FIGS. 2*a*, 2*b*, and 2*c* show the relationship between tin content and permeability, coercive force, and resistivity, respectively, in another example of the invention.
Figure 2B:
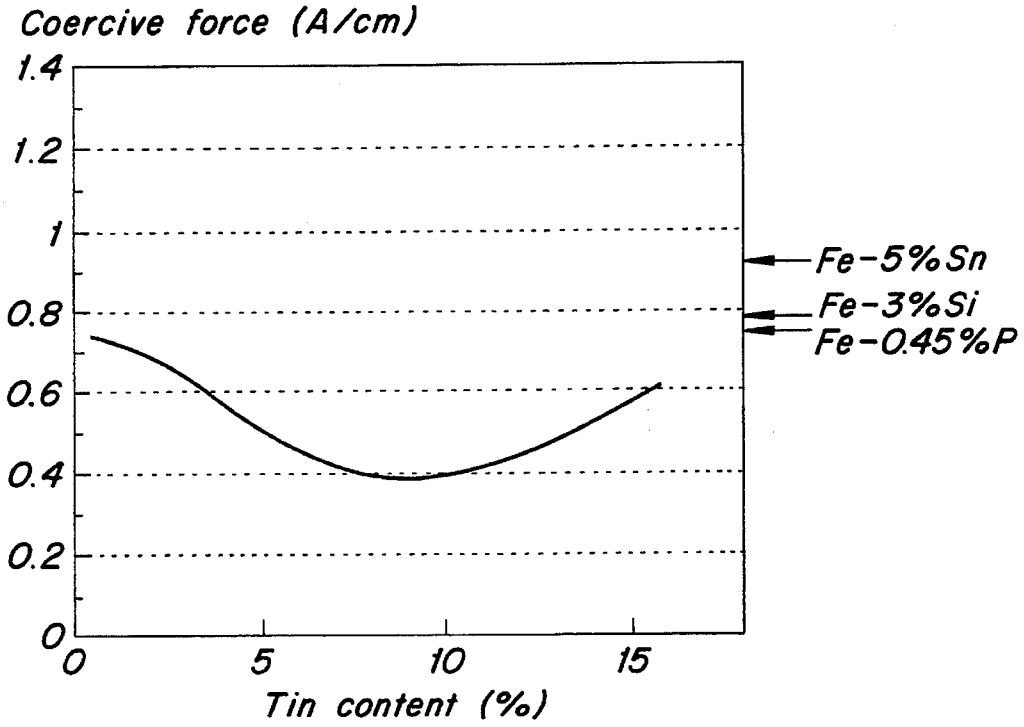
Figure 2C:
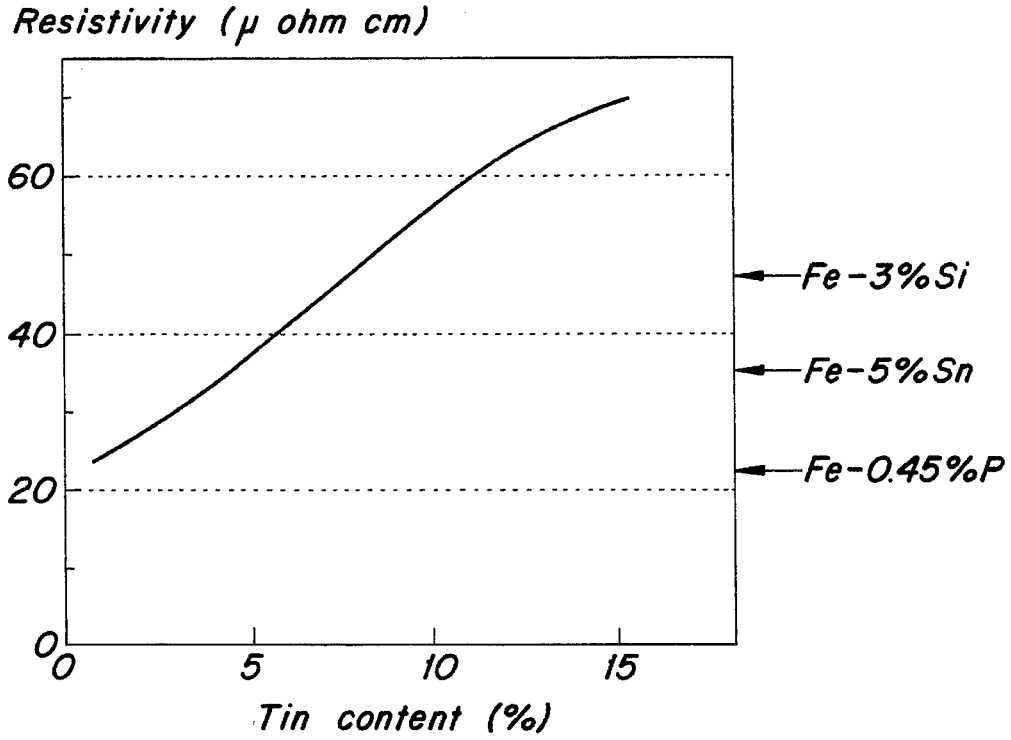

After sintering, permeability, coercive force and resistivity were measured in a similar way as in Example 1. As appears from FIGS. 2*a*, 2*b* and 2*c*, there is achieved within the content range 1.0–15.0% by weight Sn, which is the selected content range for Sn in the present invention, an improved combination of the properties permeability, coercive force and resistivity than is previously known. The upper limit for Sn, which is 15.0% by weight, is explained by the permeability showing a steeply declining trend, and the advantage of a very high resistivity then cannot make up for the drastically reduced permeability at higher Sn-contents. The lower limit for Sn, which is 1.0% by weight, is explained by too low a resistivity at lower Sn-contents which no longer makes up for the positive contribution in permeability and coercive force achievable even by small amounts of Sn. In the preferred content range, i.e. 2.0–12.0% by weight Sn, the permeability is higher and the coercive force is lower than for all three reference materials. The resistivity is similar for the inventive material and Fe-3% Si and Fe-5% Sn, while it is lower for Fe-0.45% P.

Within the preferred content range for Sn, i.e. 2.0–12.0% by weight Sn, there is shown a considerably improved combination of the properties permeability, coercive force and resistivity achievable with the inventive material as compared with the known technique.

EXAMPLE 3

Five iron-based powder compositions (K, L, M, N, O) were prepared by adding 0.45% by weight P in the form of a ferrophosphorous powder, $Fe_3P$, and different contents of Sn in the form of a metal powder, to an iron powder with a low content of impurities. The reference materials used were the same as in Example 1. The nominal chemical composition appears from Table 3 below.

TABLE 3

Nominal chemical composition of the materials tested.

| Material | Chemical composition (%) Sn | P | Si | Fe |
|---|---|---|---|---|
| K | 2.0 | 0.45 | — | Balance |
| L | 5.0 | 0.45 | — | Balance |
| M | 8.0 | 0.45 | — | Balance |
| N | 10.0 | 0.45 | — | Balance |
| O | 15.0 | 0.45 | — | Balance |
| Ref. 1 | — | — | 3.0 | Balance |
| Ref. 2 | — | 0.45 | — | Balance |
| Ref. 3 | 5.0 | — | — | Balance |

These powders were admixed with 0.6% Kenolube as lubricant, and after mixing test pieces were compacted at 600 MPa. Sintering was performed at 1250° C. for 30 min in a reducing atmosphere (hydrogen gas). The reference materials were sintered for 60 min.

Figure 3A:
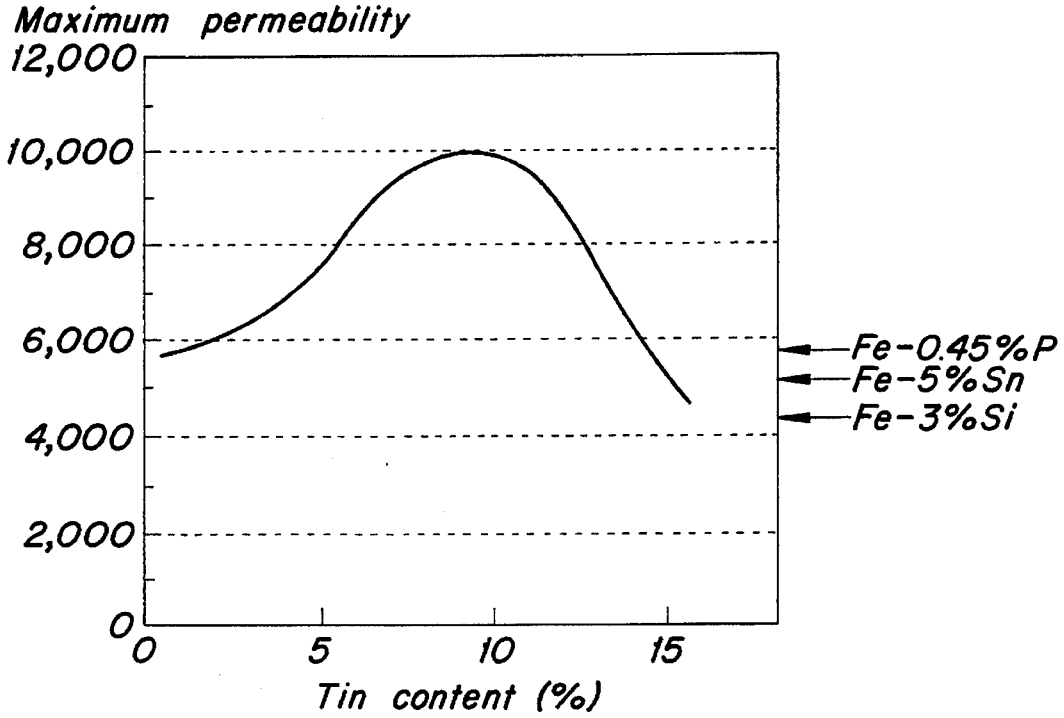
FIGS. 3*a*, 3*b*, and 3*c* show the relationship between tin content and permeability, coercive force, and resistivity, respectively, in another example of the invention.
Figure 3B:
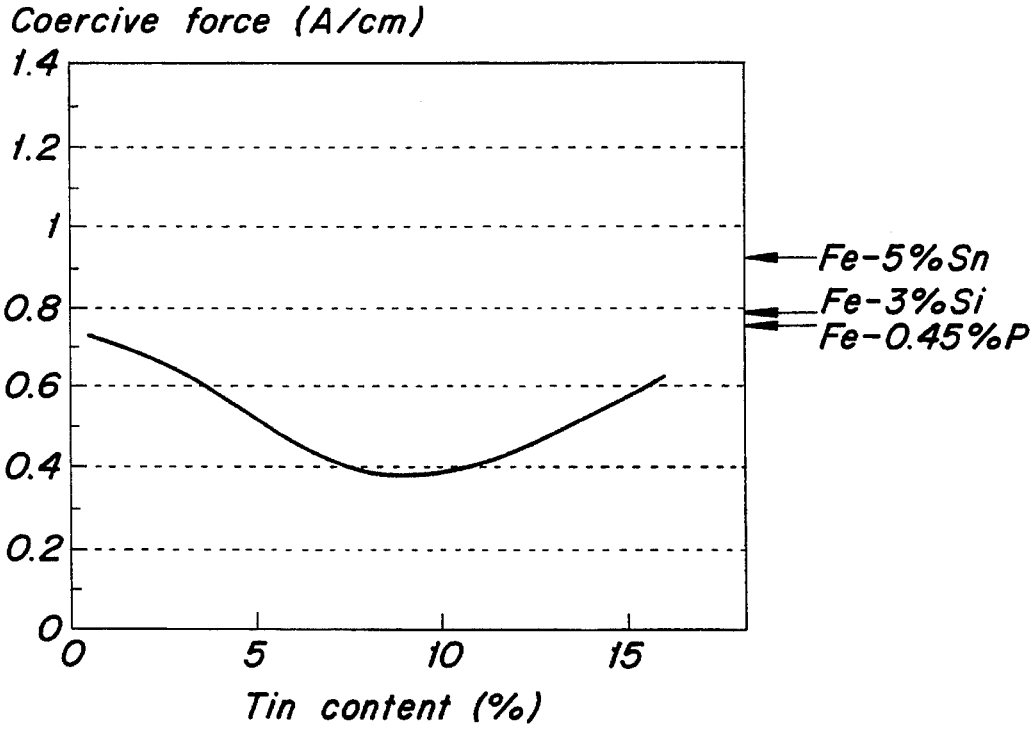
Figure 3C:
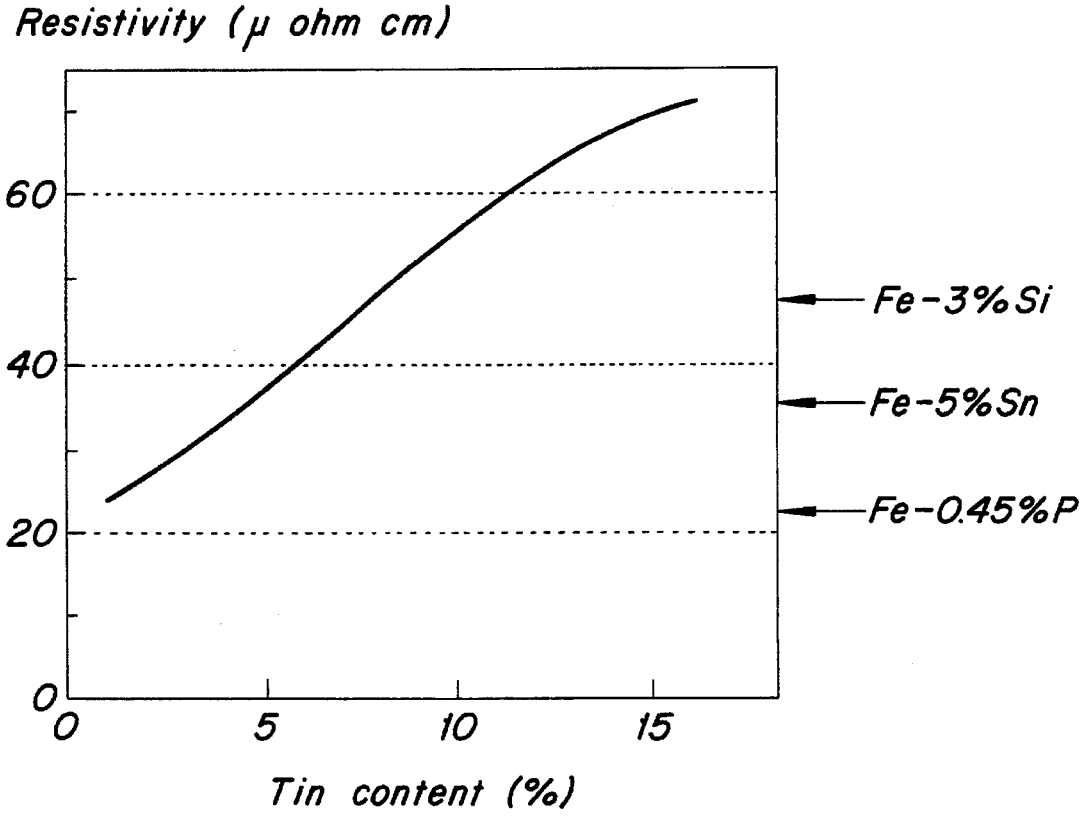

After sintering, permeability, coercive force and resistivity were measured, as illustrated in FIGS. 3*a*, 3*b* and 3*c*. As appears from these Figures, the results obtained are similar to those obtained when Sn and P are added as an SnP-alloying powder.

It is evident to those skilled in the art that similar results can be achieved if the substantially non-alloyed iron powder is admixed with a powder consisting of a combination of metallic Sn and SnP, and optionally P in the form of $Fe_3P$.

It has also been found that when compositions according to the invention are subjected to sintering in a belt furnace (at a temperature <1150° C.), similar soft magnetic properties are achieved in the sintered product as are obtained from high-temperature sintering of currently known materials. Furthermore, the sintered products prepared from a powder according to the invention exhibit a considerably smaller dimensional change than these known materials.

The following Example gives a comparison between known compositions and compositions according to the invention.

EXAMPLE 4

A iron-based powder material was prepared with the nominal chemical composition 5% Sn and 0.45% P, where Sn and P were added as an SnP-alloying powder, the remainder being Fe. The references used were Fe-3% Si and Fe-0.45% P. In all three powders, 0.6% Kenolube was admixed as lubricant, and after mixing test pieces were compacted at 600 MPa. Sintering was performed at 1120° C. for 30 min in reducing atmosphere (hydrogen gas) for the inventive powder, while the reference materials were sintered at 1250° C. for 60 min in the same type of atmosphere. Moreover, Fe-0.45% P was also sintered at 1120° C. under otherwise the same conditions as at the higher temperature. In Table 4 below, the results after sintering are compared.

TABLE 4

Sintering conditions and properties of the tested materials after sintering.

| Material | Sintering temperature time, atm. | Dimensional change % | Density g/cm³ | B-max T | Hc A/CM | μ-max | Resistivity μ ohm cm |
|---|---|---|---|---|---|---|---|
| Fe-5% Sn-0.45% P | 1120° C. 30', $H_2$ | 0.21 | 7.20 | 1.30 | 0.83 | 4800 | 43 |
| Fe-3% Si (ref.) | 1250° C. 60', $H_2$ | −1.25 | 7.21 | 1.34 | 0.79 | 4300 | 47 |
| Fe–0.45% P (ref.) | 1250° 60', $H_2$ | −0.60 | 7.40 | 1.40 | 0.75 | 5600 | 22 |
| Fe–0.45% P (ref.) | 1120° C. 60', $H_2$ | −0.30 | 7.25 | 1.35 | 0.98 | 4900 | 23 |

As appears from the Table, the properties of the inventive material are equivalent to those of the best reference material although sintering was performed at a higher temperature for two of the reference materials and, moreover, for a longer time for all three reference materials. Furthermore, the powder material according to the invention exhibits a considerably smaller dimensional change than do the references sintered at 1250° C. To sum up, it can be stated that the invention complies with the objective set, and in practice is most useful, since belt-furnace sintering can be used for many soft magnetic applications which normally require high-temperature sintering with consequent difficulties, e.g. in respect of dimensional accuracy. Still higher demands on soft magnetic properties are met by high-temperature sintering of a powder composition according to the present invention, as described in Examples 1, 2 and 3 above.

I claim:

1. An iron-based powder composition which, in addition to a substantially non-alloyed Fe-powder, comprises Sn and P, optionally lubricant and at most 1.0% by weight of impurities, the composition being selected from first and second powder compositions wherein:

a) in the first powder, Sn and P are present as an SnP-alloy in powder form, the composition including 1.0–15.0% by weight Sn and 0.2–1% by weight P; or b) in the second powder, Sn and P are present as an SnP-alloy in powder form, and, in addition, Sn is present as a metallic powder, and optionally, P is also present as ferrophosphorous powder, the composition including 1.0–15% by weight Sn and 0.2–1.5% by weight P.

2. The powder composition as claimed in claim 1, wherein said powder composition is composition (a) or (b) and said powder includes 2.0–12.0% by weight Sn and 0.3–1.2% by weight P.

3. The powder composition as claimed in claim 1, wherein said powder composition is composition (a) or (b) and most of the SnP-alloy powder has a particle size below 150 μm.

4. The powder composition as claimed in claim 1, wherein said powder composition is composition (b) and the ferrophosphorus powder has a P content of 12–17% by weight and most of the ferrophosphorus powder has a particle size below 20 μm.

5. The powder composition as claimed in claim 1, wherein the composition has a magnetic permeability of at least 4000 μ, a coercive force Hc of at least 0.4 A/cm and a resistivity of at least 40 μ-ohm.cm.

6. The powder composition as claimed in claim 1, wherein the composition is Si-free.

7. The powder composition as claimed in claim 1, wherein the composition has a magnetic permeability of at least 6000 μ, a coercive force Hc of at least 0.4 A/cm and a resistivity of at least 40 μ-ohm.cm.

* * * * *